US011583975B2

(12) United States Patent
Kawasaki

(10) Patent No.: US 11,583,975 B2
(45) Date of Patent: Feb. 21, 2023

(54) DRESSER, POLISHING DEVICE, AND METHOD OF DRESSING POLISHING PAD

(71) Applicant: Kioxia Corporation, Tokyo (JP)

(72) Inventor: Tomonori Kawasaki, Yokkaichi Mie (JP)

(73) Assignee: KIOXIA CORPORATION, Tokyo (JP)

( * ) Notice: Subject to any disclaimer, the term of this patent is extended or adjusted under 35 U.S.C. 154(b) by 592 days.

(21) Appl. No.: 16/557,429

(22) Filed: Aug. 30, 2019

(65) Prior Publication Data

US 2020/0282513 A1 Sep. 10, 2020

(30) Foreign Application Priority Data

Mar. 8, 2019 (JP) ..... JP2019-042934

(51) Int. Cl.

| | |
|---|---|
| ***B24B 53/00*** | (2006.01) |
| ***B24B 53/017*** | (2012.01) |
| ***B24B 53/12*** | (2006.01) |
| ***B24B 37/00*** | (2012.01) |

(52) U.S. Cl.

CPC ..... *B24B 53/017* (2013.01); *B24B 37/00* (2013.01); *B24B 53/12* (2013.01)

(58) Field of Classification Search

CPC ..... B24B 53/017; B24B 53/12; B24B 53/02; B24B 53/065; B24B 53/047; B24B 37/00; B24B 7/228; B24B 37/245; B24B 37/22; B24D 37/00; B24D 3/00; B24D 7/06; H01L 21/304; H01L 21/00; H01L 21/12; H01L 21/20

USPC ..... 451/56, 398, 287, 288, 285

See application file for complete search history.

(56) References Cited

FOREIGN PATENT DOCUMENTS

| | | |
|---|---|---|
| JP | 2003-305645 | 10/2003 |
| JP | 2006-324310 | 11/2006 |
| JP | 2010-030018 | 2/2010 |
| JP | 2010-125588 | 6/2010 |

*Primary Examiner* — Katina N. Henson

(74) *Attorney, Agent, or Firm* — Foley & Lardner LLP

(57) ABSTRACT

A dresser includes a main body having a stepped surface comprising a plurality of steps, wherein a thickness of the main body at a first step of the plurality of steps is a largest thickness of the main body, and a thickness of the main body at a last step of the plurality of steps is a smallest thickness of the main body; and a plurality of superhard particles disposed on each of the plurality of steps of the stepped surface. The plurality of steps of the stepped surface are different in area, and particle diameters of the superhard particles increase stepwise from the first step of the plurality of steps to the last step of the plurality of steps.

7 Claims, 4 Drawing Sheets

DRESSER, POLISHING DEVICE, AND METHOD OF DRESSING POLISHING PAD

CROSS-REFERENCE TO RELATED APPLICATION

This application claims the benefit of and priority to Japanese Patent Application No. 2019-042934, filed Mar. 8, 2019, the entire contents of which are incorporated herein by reference.

FIELD

Embodiments described herein relate generally to a dresser, a polishing device, and a method of dressing a polishing pad.

BACKGROUND

A manufacturing process for semiconductor devices can include a chemical mechanical polishing (CMP) operation of polishing metal using a polishing pad. In some cases, this CMP operation includes dressing the polishing pad using a dresser. In such cases, when operating time of the dressing process becomes long, the dresser becomes worn. As a result, dressing of the polishing pad may be insufficient and may cause defective polishing.

DETAILED DESCRIPTION

Embodiments described herein provide for a dresser, a polishing device, and a method of dressing a polishing pad that can eliminate or minimize defective polishing.

In general, according to one embodiment, a dresser includes a main body having a stepped surface including a plurality of steps, wherein a thickness of the main body at a first step of the plurality of steps is a largest thickness of the main body, and a thickness of the main body at a last step of the plurality of steps is a smallest thickness of the main body; and a plurality of superhard particles disposed on each of the plurality of steps of the stepped surface. The plurality of steps of the stepped surface are different in area, and particle diameters of the superhard particles increase stepwise from the first step of the plurality of steps to the last step of the plurality of steps.

Embodiments of the present disclosure will now be described with reference to the drawings. The embodiments are not intended to limit the present disclosure.

Figure 1:
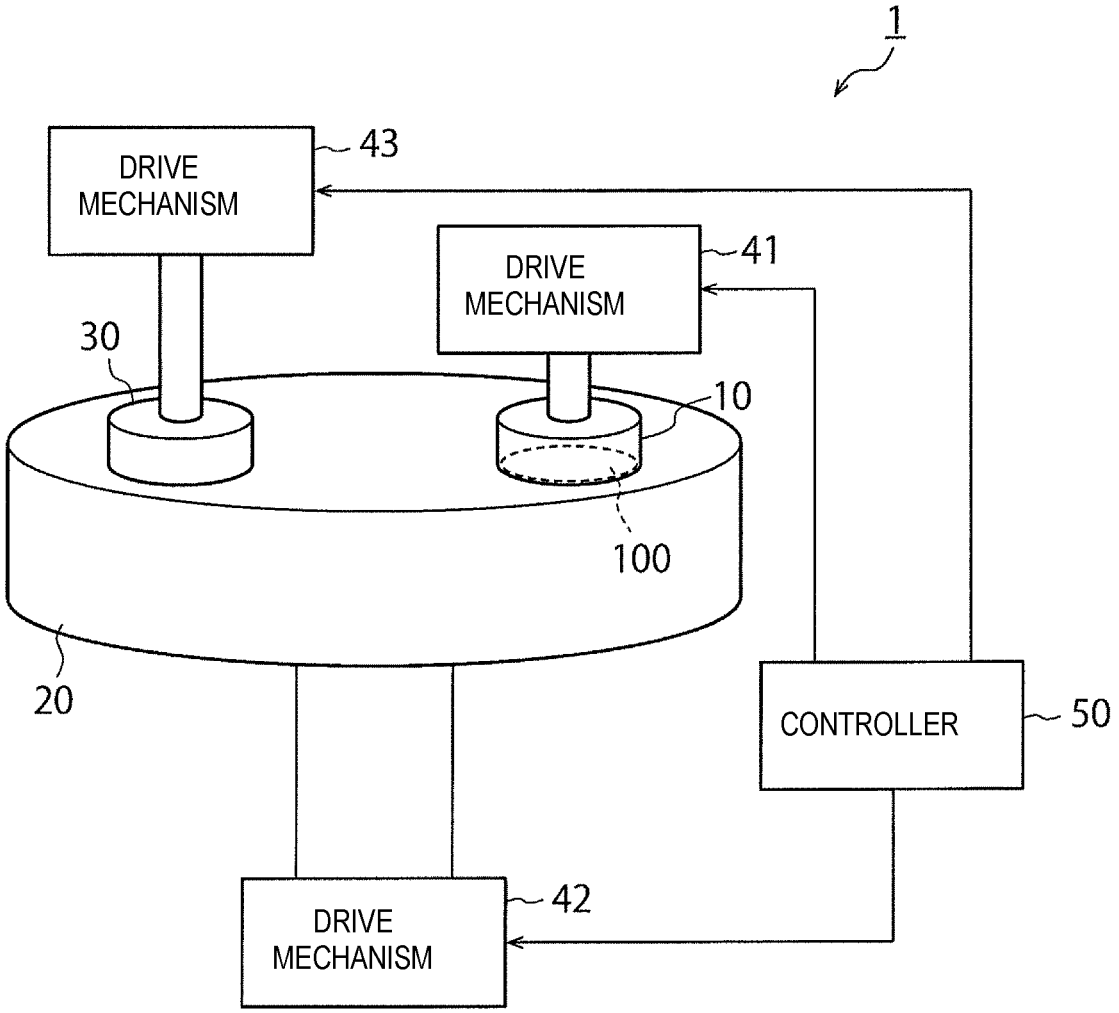
FIG. 1 is a diagram schematically illustrating a configuration of a substrate processing device according to an embodiment of the present disclosure.

FIG. 1 is a diagram illustrating a schematic configuration of a polishing device according to one embodiment. A polishing device 1 illustrated in FIG. 1 includes a head 10, a polishing pad 20, a dresser 30, drive mechanisms 41 to 43, and a controller 50.

The head 10 is disposed above the polishing pad 20. The head 10 holds a semiconductor substrate 100 in the form of a wafer on a surface of the head 10 that is opposite to the polishing pad 20. Memory cells where data is readable and writable and circuitry to drive the memory cells, for example, are formed on the semiconductor substrate 100.

The polishing pad 20 polishes a surface of the semiconductor substrate 100. An upper surface of the polishing pad 20 is made of an elastic material such as polyurethane. In this embodiment, as illustrated in FIG. 1, an area of the upper surface of the polishing pad 20 is larger than a surface area of the semiconductor substrate 100 and also larger than a surface area of the dresser 30. The area of the upper surface of the polishing pad 20 may be larger than a sum of the surface area of the semiconductor substrate 100 and the surface area of the dresser 30.

Figure 2:
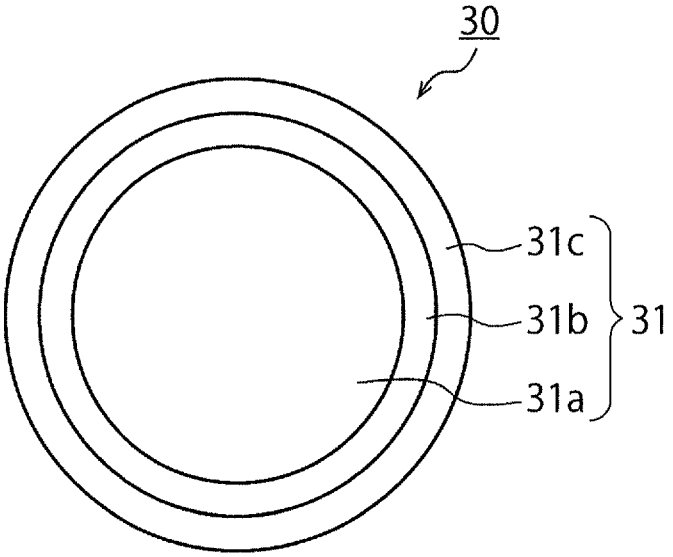
FIG. 2 is a plan view of a dresser as viewed from a side of a polishing pad, according to an embodiment of the present disclosure.
Figure 3:
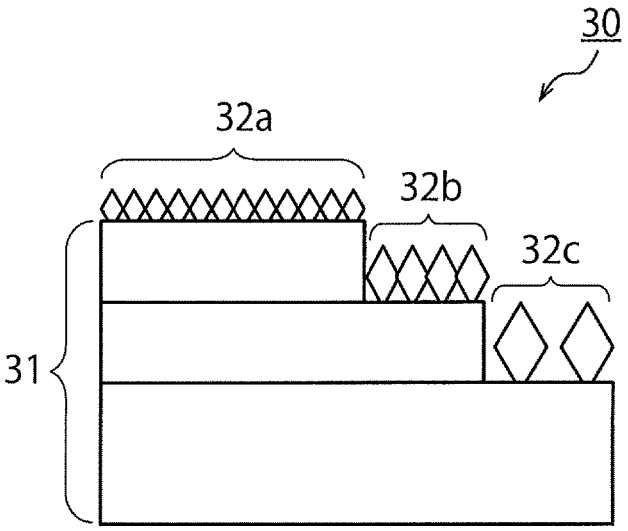
FIG. 3 is a side view of the polishing pad according to an embodiment of the present disclosure.

The dresser 30 is disposed above the polishing pad 20 and apart from the head 10. Referring now to FIGS. 2 and 3, a configuration of the dresser 30 will be described.

FIG. 2 is a plan view of the dresser 30 as viewed from the polishing pad 20 side. FIG. 3 is a side view of the polishing pad 20. As illustrated in FIGS. 2 and 3, the dresser 30 includes a main body 31 and superhard particles 32*a* to 32*c*.

The main body 31 has a stepped surface opposite to the polishing pad 20. In this embodiment, the stepped surface of the main body 31 includes surfaces 31*a*, 31*b*, and 31*c* of three steps that are adjacent to each other. The surface 31*a* (the first surface) is on an uppermost step (e.g. a step closest to the polishing pad 20) and is circular in plan view. The surface 31*b* (the second surface) is on a step adjacent to the surface 31*a* and is annular in plan view. The surface 31*c* (the third surface) is on a step adjacent to the surface 31*b* (e.g. a step farthest from the polishing pad 20) and is annular in plan view. Areas of the surfaces decrease in sequence of the surface 31*a*, the surface 31*c*, and the surface 31*b*. The surface 31*a* may have a largest area, the surface 31*b* may have a smallest area, and the surface 31*c* may have an area of a size between that of the surface 31*a* and the surface 31*b*.

In some embodiments, a thickness of the main body 31 at a first step of the three steps (corresponding to surface 31*a*) is a largest thickness of the main body 31, and a thickness of the main body 31 at a last step of the three steps (corresponding to surface 31*c*) is a smallest thickness of the main body.

The superhard particles 32*a*, 32*b*, and 32*c* are respectively disposed on the surfaces 31*a* to 31*c*. In this embodiment, the superhard particles 32*a* to 32*c* are diamonds of different particle diameters. As illustrated in FIG. 3, particle diameters of the particles increase in sequence of the superhard particles 32*a*, the superhard particles 32*b*, and the superhard particles 32*c*. That is, the particle diameters of the particles stepwise increase as a distance from the polishing pad 20 increases (e.g., a distance measured in a direction from the respective surfaces 31*a* to 31*c* to respective portions of the polishing pad that directly face the surfaces 31*a* to 31*c*). It is noted that FIG. 3 illustrates the superhard particles 32*a* to 32*c* in an enlarged manner (not necessarily to scale) to show differences in particle diameter.

The superhard particles 32*a* may be disposed on the surface 31*a*, the superhard particles 32*b* may be disposed on the surface 31*b*, and the superhard particles 32*c* may be disposed on the surface 31*c*. The superhard particles 32*a* may have a similar particle diameter (e.g. with a variation of no more than about 50%, no more than about 25%, no more than about 15%, or no more than about 5% of an average particle diameter of the superhard particles 32*a*). The superhard particles 32*b* may have a similar particle diameter (e.g. with a variation of no more than about 50%, no more than about 25%, no more than about 15%, or no more than about 5% of an average particle diameter of the superhard particles 32*b*). The superhard particles 32*c* may have a similar particle diameter (e.g. with a variation of no more than about 50%, no more than about 25%, no more than about 15%, or no more than about 5% of an average particle diameter of the superhard particles 32*c*). The average particle diameter of the superhard particles 32*b* may be larger than the average particle diameter of the superhard particles 32*a*. The average particle diameter of the superhard particles 32*c* may be larger than the average particle diameter of the superhard particles 32*b*.

The drive mechanism 41 drives rotation of the head 10 on the polishing pad 20. The drive mechanism 41 includes components, such as a motor (not illustrated) coupled to the head 10, and a drive circuit (not illustrated) to drive the motor based on control by the controller 50.

The drive mechanism 42 drives rotation of the polishing pad 20. The drive mechanism 42 includes components, such as a motor (not illustrated) coupled to the polishing pad 20, and a drive circuit (not illustrated) to drive the motor based on control by the controller 50.

The drive mechanism 43 drives rotation of the dresser 30 and adjusts a load applied to the dresser 30. The drive mechanism 43 includes components, such as a motor (not illustrated) coupled to the dresser 30, a drive circuit (not illustrated) to drive the motor based on control by the controller 50, and a compressor (not illustrated) to press the dresser 30 based on control by the controller 50. The drive mechanism 43 is configured to increase a load applied to the dresser 30 such that an operating circumference of the dresser 30 or the polishing pad 20 (e.g. a circumference of a portion of the dresser 30 that is in contact with the polishing pad 20 during dressing, or a circumference of a portion of the polishing pad 20 that is in contact with the dresser 30 during dressing) increases.

The controller 50 controls each of the drive mechanisms 41 to 43 based on one or more predetermined programs (e.g., processor-executable programs stored on machine-readable media). For example, when polishing the semiconductor substrate 100, the controller 50 controls the drive mechanisms and 42. Thus, the semiconductor substrate 100 and the polishing pad 20 are rotated simultaneously in the same direction to polish the surface of the semiconductor substrate 100. It is noted that the controller 50 may control the drive mechanisms 41 and 42 to rotate one of the semiconductor substrate 100 and the polishing pad 20 or rotate the semiconductor substrate 100 and the polishing pad 20 in directions opposite to each other.

Figure 4A:
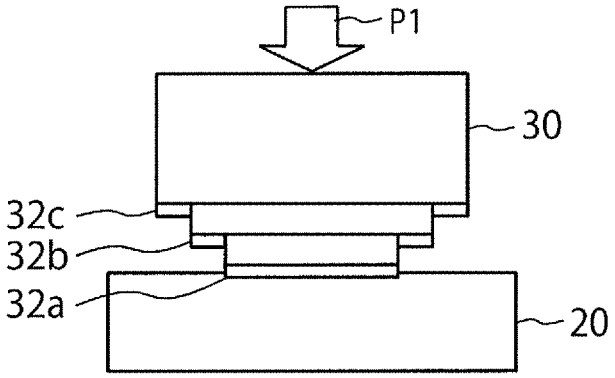
FIG. 4A is a cross-sectional view of the dresser, illustrating how the polishing pad is dressed with superhard particles according to an embodiment of the present disclosure.
Figure 4B:
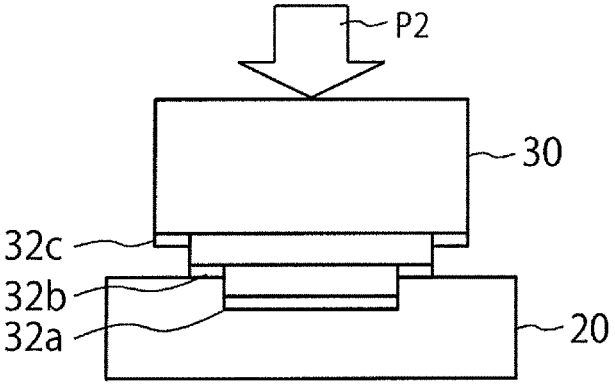
FIG. 4B is a cross-sectional view of the dresser, illustrating how the polishing pad is dressed with other superhard particles according to an embodiment of the present disclosure.
Figure 4C:
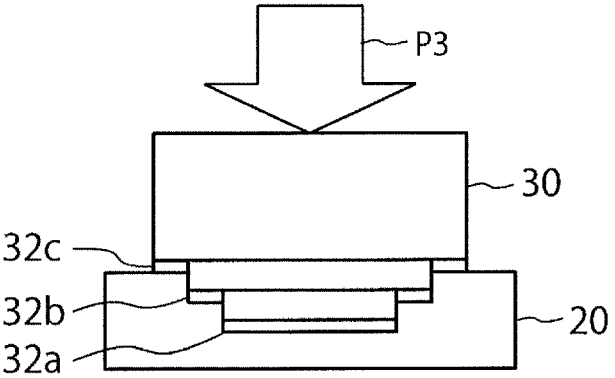
FIG. 4C is a cross-sectional view of the dresser, illustrating how the polishing pad is dressed with still other superhard particles according to an embodiment of the present disclosure.

When polishing the semiconductor substrate 100 is ended, the polishing pad 20 is dressed. Referring now to FIGS. 4A to 4C, a method of dressing the polishing pad 20 according to this embodiment will be described.

First, as illustrated in FIG. 4A, the drive mechanism 43 applies a load P1 to the dresser 30 toward the polishing pad 20 side based on control by the controller 50. This makes the superhard particles 32*a* disposed on the uppermost surface 31*a* of the dresser 30 come into contact with the surface of the polishing pad 20. At this time, the superhard particles 32*b* and 32*c* are not in contact with the surface of the polishing pad 20.

With the superhard particles 32*a* being in contact with the surface of the polishing pad 20, when the controller 50 controls the drive mechanisms 42 and 43, the polishing pad 20 and the dresser 30 are rotated simultaneously in the same direction. Thus, the polishing pad 20 is dressed by the superhard particles 32*a*. It is noted that the controller 50 may control the drive mechanisms 42 and 43 to rotate one of the polishing pad 20 and the dresser 30 or rotate the polishing pad 20 and the dresser 30 in directions opposite to each other.

When dressing time of the polishing pad 20 by the superhard particles 32*a* becomes a first preset time lapse, the drive mechanism 43 applies a load P2 to the dresser 30 toward the polishing pad 20 side based on control by the controller 50. The load P2 is larger than the load P1 such that not only the superhard particles 32*a* but also the superhard particles 32*b* come into contact with the surface of the polishing pad 20. Thus, the polishing pad 20 is dressed by the superhard particles 32*b*.

In this embodiment, while an area of the surface 31*b* of the main body 31 where the superhard particles 32*b* are disposed is smaller than an area of the surface 31*a* where the superhard particles 32*a* are disposed, the particle diameter of the superhard particles 32*b* is larger than the particle diameter of the superhard particles 32*a*. Therefore, even when the polishing pad 20 is dressed by the superhard particles 32*b*, a dressing amount equivalent to or similar to a dressing amount by the superhard particles 32*a* can be secured.

When dressing time of the polishing pad 20 by the superhard particles 32*b* becomes a second preset time lapse, the drive mechanism 43 applies a load P3 to the dresser 30 toward the polishing pad 20 side based on control by the controller 50. The load P3 is larger than the load P2 such that not only the superhard particles 32*a* and 32*b* but also the superhard particles 32*c* come into contact with the surface of the polishing pad 20. Thus, the polishing pad 20 is dressed by the superhard particles 32*c*.

In this embodiment, an area of the surface 31*c* of the main body 31 where the superhard particles 32*c* are disposed is larger than the area of the surface 31*b* where the superhard particles 32*b* are disposed, and the particle diameter of the superhard particles 32*c* is larger than the particle diameter of the superhard particles 32*b*. Therefore, when the polishing pad 20 is dressed by the superhard particles 32*c*, a dressing amount larger than the dressing amount by the superhard particles 32*b* can be obtained.

Although FIG. 3 shows a dresser 30 with a stepped surface having three steps, in some embodiments a different number of steps may be implemented (e.g. two steps, or four or more steps). Accordingly, although FIG. 4A to FIG. 4C shows three stages of dressing having three different loads applied, a different number of stages having a different number of loads may be implemented (e.g. two stages with two respective loads, or four or more stages with four or more respective loads).

Figure 5:
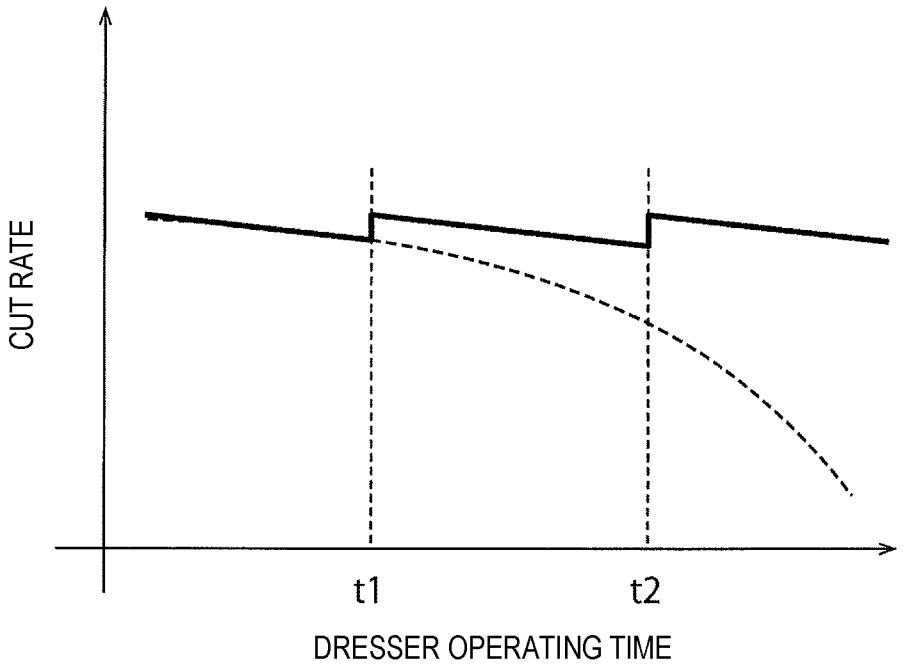
FIG. 5 is a graph illustrating a relationship between an operating time of the dresser and a cut rate by the polishing pad according to an embodiment of the present disclosure.

FIG. 5 is a graph illustrating a relationship between operating time of the dresser 30 and a cut rate by the polishing pad 20. In FIG. 5, the horizontal axis indicates the operating time of the dresser 30, and the vertical axis indicates the cut rate by the polishing pad 20. The cut rate represents a polishing amount by the polishing pad 20 per unit time.

Assuming that dressing of the polishing pad 20 is continued while the load P1 applied to the dresser 30 by the drive mechanism 43 is kept constant, the cut rate by the polishing pad 20 decreases as the operating time of the dresser 30 elapses, as indicated with the dotted curve in FIG. 5. In this case, residual film remains due to defective polishing of the semiconductor substrate 100, and a malfunction, for example, a leak current flowing between pieces of metal wiring such as bit lines, may occur.

However, in this embodiment, as described above, when the operating time of the dresser 30 becomes the first preset time lapse t1, the drive mechanism 43 applies the load P2 larger than the load P1 to the dresser 30. Thus, dressing by the superhard particles 32*a* is switched to dressing by the superhard particles 32*b*. Therefore, even when the superhard particles 32*a* are worn, the cut rate by the polishing pad 20 can be prevented from decreasing.

After that, when the operating time of the dresser 30 becomes the second preset time lapse t2, the drive mechanism 43 applies the load P3 even larger than the load P2 to the dresser 30. Thus, dressing by the superhard particles 32*b* is switched to dressing by the superhard particles 32*c*. Therefore, even when the superhard particles 32*b* are worn after the superhard particles 32*a*, the cut rate by the polishing pad 20 can be prevented from decreasing.

According to the above-described embodiment, the surface of the main body 31 of the dresser 30 has the steps, and the superhard particles having different particle diameters are disposed on the surfaces of the steps. The drive mechanism 43 increases the load applied to the dresser 30 in accordance with a lapse of operating time of the dresser 30.

Thus, the polishing pad 20 can be dressed by the substantially unworn, fresh superhard particles to stabilize the cut rate by the polishing pad 20. This can eliminate or minimize defective polishing. It is noted that although the polishing pad 20 is dressed after polishing the semiconductor substrate 100 in this embodiment, polishing the semiconductor substrate 100 and dressing the polishing pad 20 may be performed concurrently.

It is noted that timing to change the load applied to the dresser 30 is not limited to the preset lapses of operating time. For example, the controller 50 may instruct the timing to the drive mechanism 43 based on an image of the dresser 30 captured by an imaging device (not illustrated) such as a camera.

When the image displays the surface of the dresser 30, the image may be transmitted to the controller 50, and the controller 50 evaluates a wear condition of the superhard particles to determine the timing(s) for applying the load P1, P2, and/or P3. When the image displays the steps of the surface of the dresser 30, the controller 50 evaluates a wear condition of the superhard particles based on heights of the steps to determine the timing.

Since a state of the dresser 30 can be indirectly evaluated from an operating circumstance of the polishing pad 20, the controller 50 may determine the timing to change the load applied to the dresser 30 in accordance with the operating circumstance of the polishing pad 20. For example, at a time when the number of semiconductor substrates 100 polished by the polishing pad 20 exceeds a predetermined number, the controller 50 may instruct the drive mechanism 43 to apply a different load (e.g., P2 or P3). Thus the timing can be appropriately set.

As used herein, the term "about" is used to describe and account for small variations. When used in conjunction with an event or circumstance, the term can refer to instances in which the event or circumstance occurs precisely as well as instances in which the event or circumstance occurs to a close approximation. For example, when used in conjunction with a numerical value, the term can refer to a range of variation of less than or equal to ±10% of that numerical value, such as less than or equal to ±5%, less than or equal to ±4%, less than or equal to ±3%, less than or equal to ±2%, less than or equal to +1%, less than or equal to ±0.5%, less than or equal to ±0.1%, or less than or equal to ±0.05%.

While certain embodiments have been described, these embodiments have been presented by way of example only, and are not intended to limit the scope of the present disclosure. Indeed, the embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A dresser comprising:

a main body having a stepped surface comprising a plurality of steps, wherein a thickness of the main body at a first step of the plurality of steps is a largest thickness of the main body, and a thickness of the main body at a last step of the plurality of steps is a smallest thickness of the main body; and a plurality of superhard particles disposed on each of the plurality of steps of the stepped surface, wherein the plurality of steps of the stepped surface are different in area, and respective particle diameters of the superhard particles increase stepwise from the first step of the plurality of steps to the last step of the plurality of steps, the plurality of steps comprises the first step having a first surface, a second step adjacent to the first step and having a second surface, and a third step adjacent to the second step and having a third surface, the third step is the last step, and the particle diameters increase in sequence of the superhard particles disposed on the first surface, the superhard particles disposed on the second surface, and the superhard particles disposed on the third surface, in plan view, the first surface is circular, and the second surface and the third surface are annular, an area of the first surface is larger than an area of the second surface, and the area of the first surface is larger than an area of the third surface, an area of the third surface is larger than an area of the second surface, and in plan view, the second surface is positioned in periphery of the first surface and the third surface is positioned in periphery of the second surface.

2. A method of dressing a polishing pad using the dresser according to claim 1, the method comprising increasing a load applied to the dresser such that an operating circumference of the dresser or the polishing pad increases.

3. The dresser according to claim 1, wherein the superhard particles comprise diamonds.

4. The dresser according to claim 1, wherein in side view, a number of the superhard particles disposed on the first surface is more than a number of the superhard particles disposed on the second surface.

5. The dresser according to claim 4, wherein in side view, the number of the superhard particles disposed on the second surface is more than a number of the superhard particles disposed on the third surface.

6. The dresser according to claim 5, wherein the superhard particles comprise diamonds.

7. The dresser according to claim 4, wherein the superhard particles comprise diamonds.

* * * * *